United States Patent [19]

Jentoft et al.

[11] Patent Number: 4,862,657

[45] **Date of Patent: * Sep. 5, 1989**

[54] VENTILATING SKYLIGHT

[75] Inventors: Arthur P. Jentoft, Kennebunkport; Paul A. Couture, Emery Mills, both of Me.

[73] Assignee: Wasco Products, Inc., Sanford, Me.

[ * ] Notice: The portion of the term of this patent subsequent to May 22, 2001 has been disclaimed.

[21] Appl. No.: 219,651

[22] Filed: Jul. 15, 1988

Related U.S. Application Data

[63] Continuation of Ser. No. 152,459, Feb. 5, 1988, abandoned, which is a continuation of Ser. No. 819,938, Jan. 21, 1986, abandoned, which is a continuation of Ser. No. 577,557, Feb. 6, 1984, Pat. No. 4,570,394, which is a continuation of Ser. No. 341,773, Jan. 22, 1982, Pat. No. 4,449,340.

[51] Int. Cl.[4] ..... E04B 7/18

[52] U.S. Cl. ..... 52/200; 52/309.1

[58] Field of Search ..... 52/72, 200, 309.15, 52/309.16, DIG. 7; 49/DIG. 2, 498; 428/515; 16/355

[56] References Cited

U.S. PATENT DOCUMENTS

| | | | |
|---|---|---|---|
| 3,399,500 | 9/1968 | Shapiro | 52/200 X |
| 3,448,543 | 6/1969 | Multer | 49/498 X |
| 3,455,073 | 7/1969 | Kiekhaefer | 52/200 |
| 4,169,180 | 9/1979 | McDonagh | 52/309.1 X |
| 4,455,799 | 6/1984 | Jentoft et al. | 52/200 |
| 4,514,943 | 5/1985 | Jentoft et al. | 52/200 |
| 4,570,394 | 2/1986 | Jentoft et al. | 52/72 |

*Primary Examiner*—Carl D. Friedman

*Attorney, Agent, or Firm*—Wolf, Greenfield & Sacks

[57] ABSTRACT

A skylight that may have a domed-type or flat-type glazing and which is adapted to fit within the opening of a roof or the like having a peripheral frame which is fixed to the roof about the opening. The frame is constructed including a base frame and an operating leaf frame usually referred to as an operating leaf frame or operating leaf. A retainer is used for securing the skylight cover over the operating leaf frame. The frame comprises a rigid plastic profile (core) having high temperature resistant properties and a plastic capping material extruded over the external exposed surface of the core to protect the profile from weathering. There is also preferably provided with the profile and capping, a flexible gasket means which may include respective gaskets associated with both the base frame and the operating leaf frame.

6 Claims, 4 Drawing Sheets

56
22
36
20
45
68
14
28
51
34
39
66
24
26
17
44
60
62
72
78
76
55
57
29
30
18
16
21
70
74
53
54
42
38
40

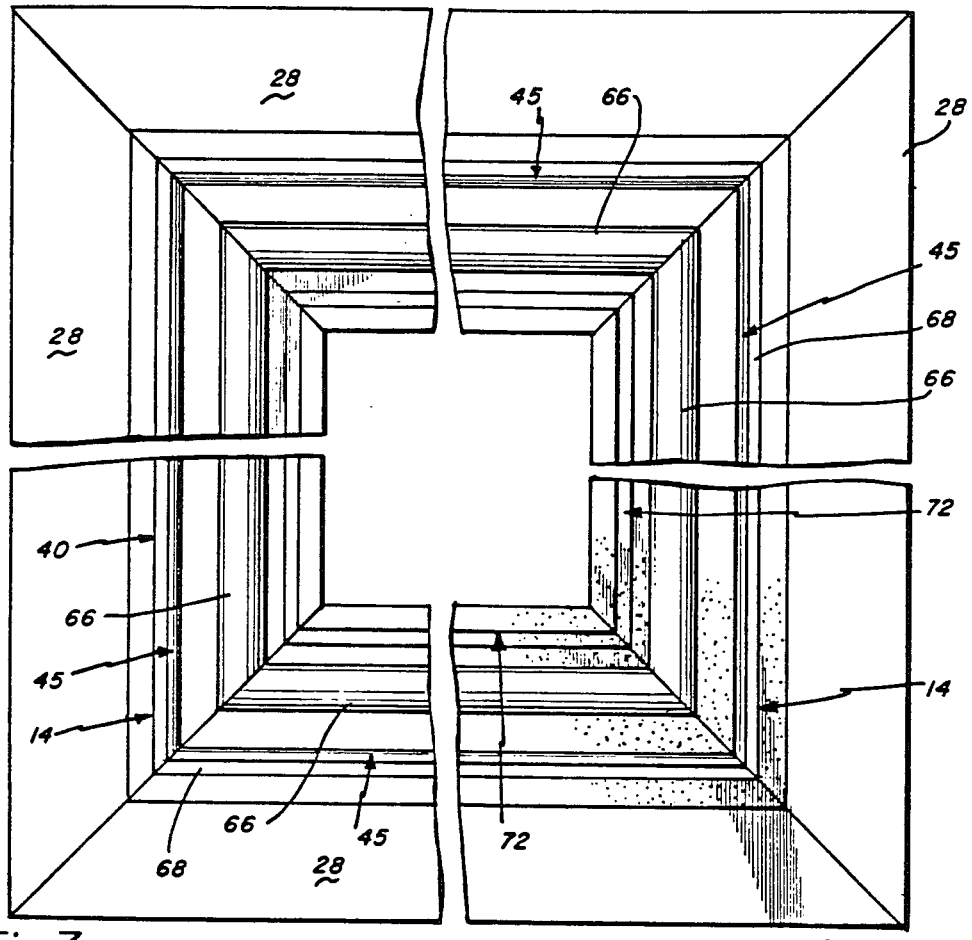
Fig.3
Fig. 4
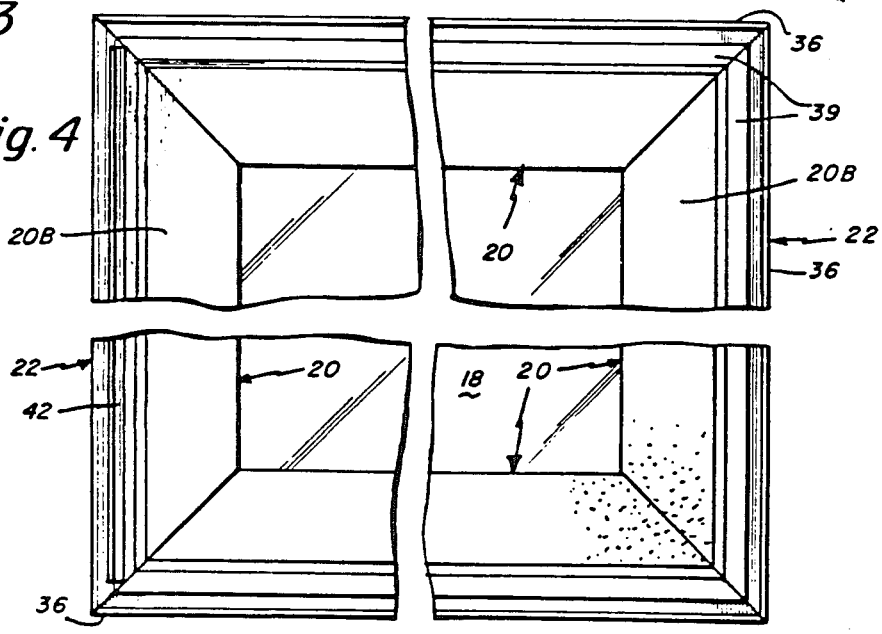

VENTILATING SKYLIGHT

This application is a continuation of application Ser. No. 152,459, filed 2/5/88, now abandoned, which is a continuation of Ser. No. 819,938, filed Jan. 21, 1986, which is a continuation of Ser. No. 577,557, filed Feb. 6, 1984, now U.S. Pat. No. 4,570,394 which is a continuation of Ser. No. 341,773, filed Jan. 22, 1982, now U.S. Pat. No. 4,449,340.

BACKGROUND OF THE INVENTION

The present invention relates in general to an improved skylight construction and is concerned, more particularly with an improved skylight construction preferably formed by co-extruded plastic thus adapting itself to simplified manufacture and improved temperature resistant and weathering properties.

Copending application Ser. No. 309933, filed Oct. 9, 1981, discloses a thermal barrier skylight in which the curb frame is constructed of an aluminum material. Also, copending application Ser. No. 249,072 filed Mar. 30, 1981, discloses a residential skylight which uses a co-extrusion technique employing a rigid plastic frame with an integral flexible gasket. In products of this type it is desired that the skylight many times be made in a dark residential bronze color thus usually requiring the use of high temperature resistant materials. This is due to the increase in temperature caused by increased heat absorption with the use of such dark colors. The problem, however, is that high temperature plastics in such dark colors are not sufficiently weatherable and often have other deficiencies such as not having the necessary fire resistant properties.

Accordingly, it is an object of the present invention to overcome the aforementioned problems and to provide a plastic frame ventilating skylight that is made in co-extruded form preferably using a tri-extruded frame including a rigid core material with the necessary temperature resistant properties but generally with a poor weatherability characteristic in combination with a capping material extruded over the entire exposed surface of the rigid core to protect the core from weathering.

Another object of the present invention is to provide a new and improved ventilating skylight employing a curb frame that is comprised of a base frame and an overlying operating leaf frame with a gasket disposed intermediate the frames.

Another object of the present invention is to provide an improved ventilating skylight constructed using primarily only plastic materials and further adapted for supporting triple glazing.

Still another object of the present invention is to provide a ventilating skylight employing both fixed and operating leafs wherein the pivot therebetween is defined in the extrusion profile.

SUMMARY OF THE INVENTION

To accomplish the foregoing and other objects of this invention, there is provided a skylight construction adapted to be fitted into an opening in a building such as either a commercial building or a residential building. The skylight construction comprises a frame means extending about the opening and including means securable about the opening, and a translucent or transparent means covering the opening and extending at its edges to overlie the frame means. The covering means may comprise one or more glazing plates, or they may also be in the form of one or more glazing domes. A retainer extends about the periphery of the skylight for holding the panels on the frame means. The frame may comprise a base frame and a operating leaf frame overlying the base frame. The frame means is constructed comprising a rigid plastic profile having high temperature resistant properties in combination with a plastic capping material extruded over the external exposed surface of the core to protect the core from weathering. The frame means may comprise a base frame and an operating leaf frame and the frame means may further comprise at least one flexible gasket integrally formed with the plastic profile. There may actually be provided two flexible gaskets one a hollow gasket extending from the base frame and disposed sandwiched between the base frame and overlying operating leaf frame and a further gasket extending from the operating leaf frame and disposed between the operating leaf frame and the covering means. In accordance with the present invention there are also provided hinge means between the base frame and operating leaf frame. This hinge means comprises means defining an arcuate channel integral with the base frame profile and means defining an arcuate rib integral with the operating leaf frame retainer.

BRIEF DESCRIPTION OF THE DRAWINGS

Numerous other objects, features and advantages of the invention will become apparent upon a reading of the following detailed description taken in conjunction with the accompanying drawing, in which:

FIG. 3 is a top plan view of the frame depicted in FIG. 1;

FIG. 4 is an enlarged view of the skylight construction of FIG. 1;

DETAILED DESCRIPTION

Figure 1:
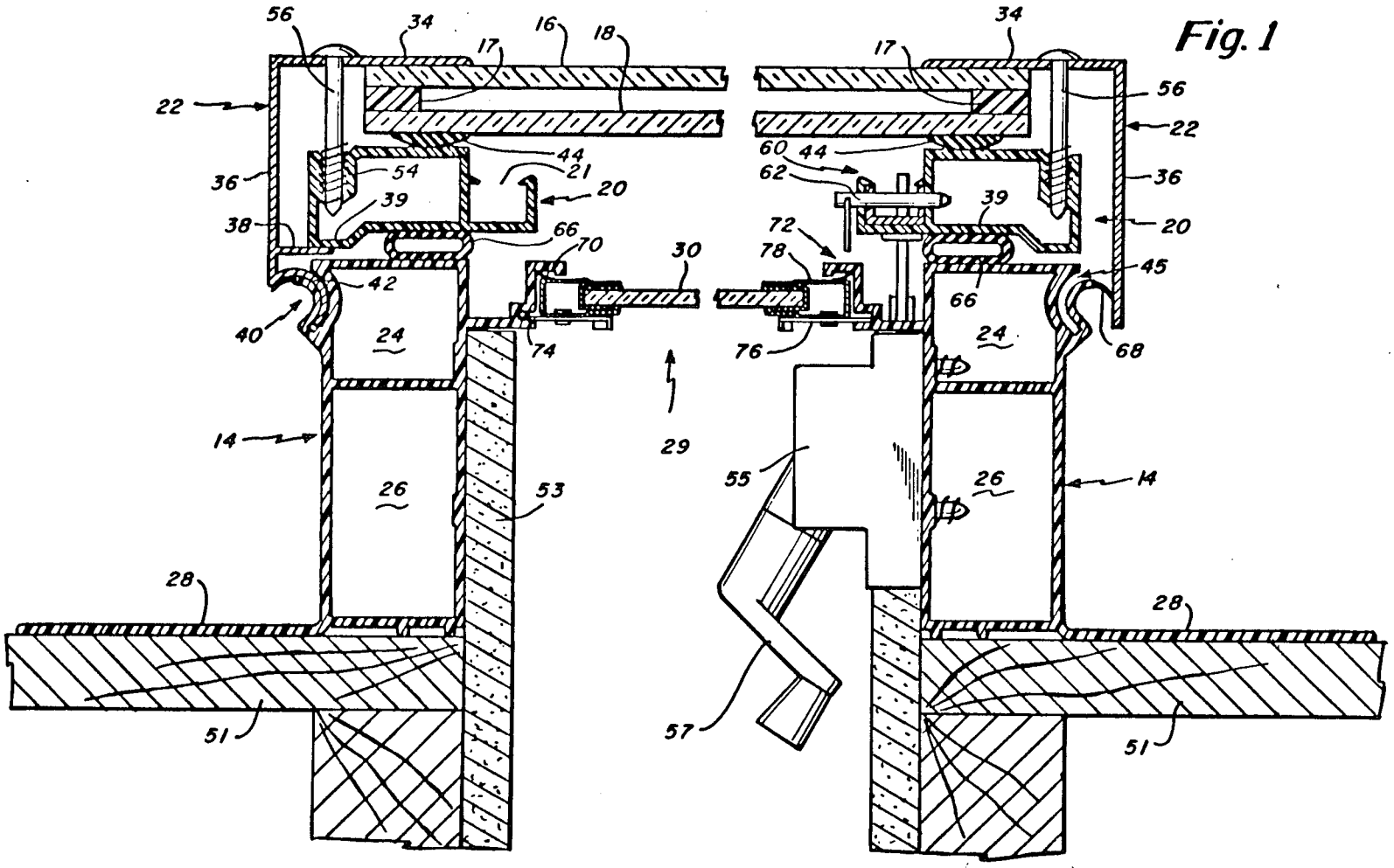
FIG. 1 is a cross-sectional view of a flat-type plastic framed ventilating skylight embodying the principles of the present invention.

With reference to the drawings, FIG. 1 shows a cross-sectional view of a skylight constructed in accordance with the principles of the present invention. Somewhat more detail is shown in the fragmentary view of FIG. 2. In the embodiment of FIG. 1, the skylight is of a flat construction, and it is adapted to span an opening which is generally of square or rectangular shape and may be defined by upright walls or by roof construction. The skylight construction shown includes a pair of glazing plates 16 and 18, a base frame 14, an operating leaf frame 20, and a retainer 22. The two frames 14 and 20 are constructed in a tri-extruded form as discussed in detail hereinafter. The retainer 22 is preferably constructed of metal.

The base frame 14 may also be referred to as the fixed leaf while the support frame 20 may be referred to as the overlying operating leaf. The base frame 14 has internal compartments 24 and 26 and a peripheral flange 28 for attachment of the entire base frame to a roof construction or the like. The base frame 14 defines an opening 29 in which is supported a third panel 30 which may be a glazing panel, screen or the like.

The skylight glazing plates 16 and 18 are supported over the support frame 20 by means of the retainer 22. The plates 16 and 18 are separated by a gasket 17 which may be of a premolded butyl material which may be in the form of a tape. The seal between the plates 16 and 18 may also comprise metal spacers, (not shown) with an outside seal comprising a chemically curable two part polysulfide. The lower plate 18 rests upon a cupped-shaped sealing gasket 44 which is co-extruded with the support frame 20. The operating leaf or support frame 20, also includes means defining a channel 54 for receiving a securing bolt 56. The channel 54 is properly threaded to receive the bolt 56. There are preferably a plurality of these securing bolts or screws that are employed for securing the retainer 22 over the glazing plates 16 and 18.

The retainer 22 has a top leg 34 and a side leg 36. Along the side of the retainer at the hinge 40 there is provided a lower wall 38. The lower wall 39 of the support frame 20 rests upon the wall 38 of the retainer. The retainer 22 also has at its bottom end, an arcuate rib 42 which forms part of the hinge 40. The rib 42 of the retainer is adapted to engage in the channel 45 defined between the walls 46 and 47 of the frame 14. In addition to the cross-sectional view of FIG. 1 also refer to the somewhat enlarged view of FIG. 2.

FIG. 1 shows part of the building construction including building member 51 to which the flange 28 may be secured. About the opening 29 there is also provided member 53 which may be in the form of typical building construction material such as drywall or the like material. In the opening 29 there is also shown the operator 55 with its associated handle 57. The operator may be of conventional design and is simply used to open and close the skylight. FIG. 1 illustrates a locking mechanism 60 including a locking pin 62 adapted to engage with the support frame 20. Because the operating mechanism may be one of conventional design, it is not discussed in detail herein.

The support frame 20, in addition to supporting the gasket 44 and receiving the bolt 56, also has a condensation gutter 21. Also, as indicated in FIG. 1, the bottom wall 39 of the frame 20 is adapted to engage the compliant hollow gasket 66. FIG. 1 shows the gasket 66 in its compressed position while FIG. 2 shows it in its uncompressed fully cylindrical position.

In addition to the gasket 66, the frame of this invention also has other gaskets associated therewith including the previously mentioned cup-shaped gasket 44 and gaskets 68 and 70. The gasket 68 extends from the end of the arcuate wall 46. In FIG. 2 this is shown simply engaging the arcuate rib 42 of the retainer. However, in FIG. 1 the gasket 68 is shown in a position for sealing between the frame 14 and the retainer 22, particularly the leg 36 of the retainer. The other gasket 70 is associated with a support piece 72 extending from and forming a part of the base frame 14. FIG. 1 also shows the support piece 72 for supporting the third glazing or screen 30. In this regard the piece 72 has a slot 74 for receiving the plate 76 which has supported therefrom the frame 78 which supports the periphery of the plate 30. The gasket 70, when the third glazing or screen panel is in place, is urged against the frame 78.

Figure 2:
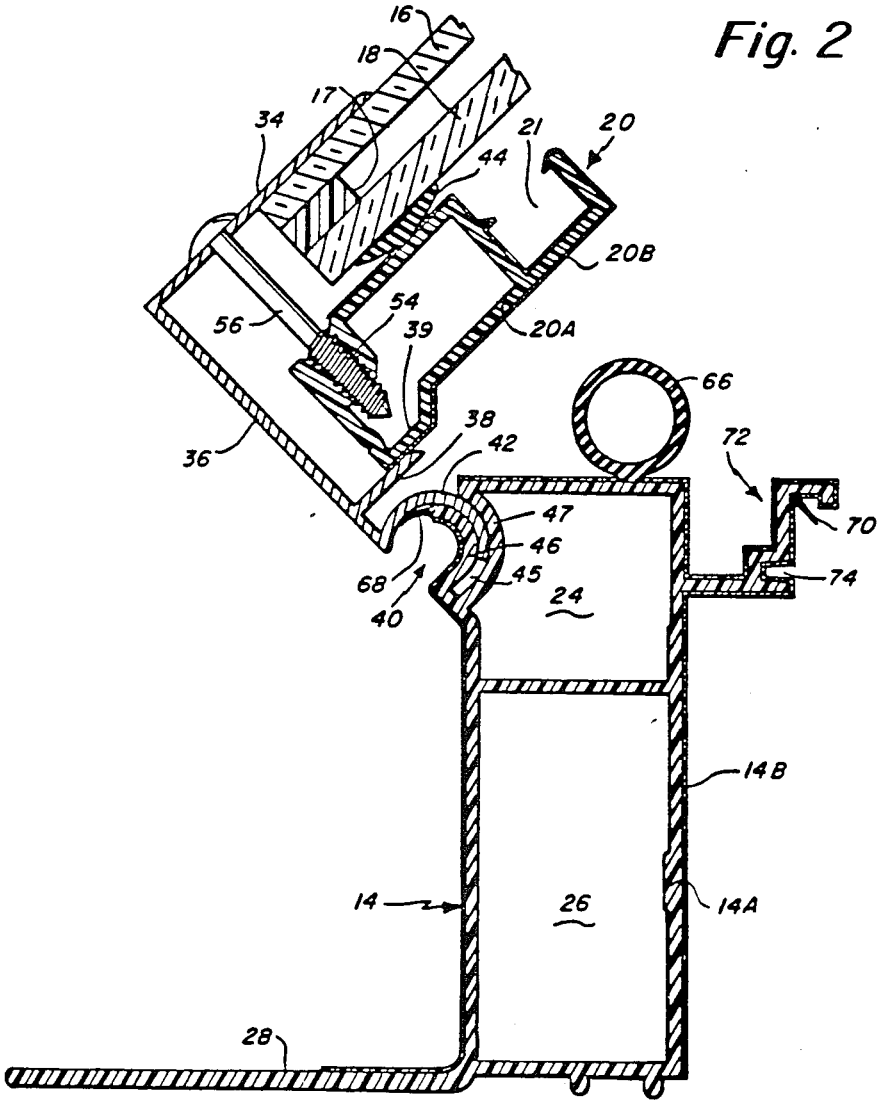
FIG. 2 is a more detailed view of a portion of the skylight shown in FIG. 1 illustrating the skylight in an open position.
Figure 5:
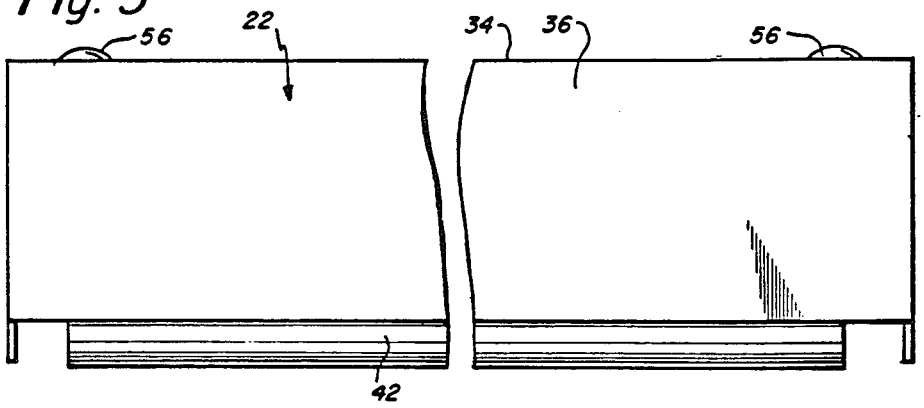
FIG. 5 is a side view of the operating leaf of the skylight.
Figure 6:
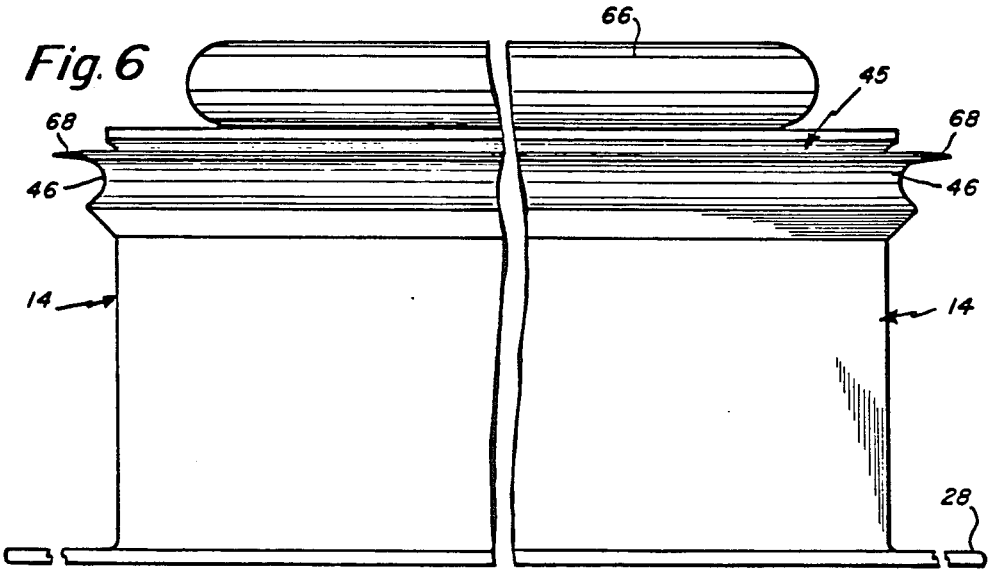
FIG. 6 is a side view of the fixed leaf of the skylight.

As particularly depicted in FIG. 2, the specific construction of the frame is shown. Both sections of the frame, namely the base frame 14 and the support frame 20 comprise a rigid core material with the necessary temperature resistant properties, along with a capping material extruded over the entire exposed surface of the rigid core to protect the core from weathering. Thus, the frame 14 includes a rigid core 14A and a capping material or layer 14B which as noted in FIG. 2 extends about the entire exposed area of the base frame. Similarly, the support frame 20 includes a rigid core material 20A covered with a capping layer or material 20B. Again, the later 20B extends about the entire exposed area of the support frame 20.

With regard to the improved frame of this invention, the core material for cores 14A and 20A may be a rigid CPVC identified as GEON #88940. This is made by B. F. Goodrich Company, Chemical Division, 6100 Oak Tree Boulevard, Cleveland, Ohio. This has a specific gravity of 1.44. The hardness Rockwell "R", method "A"=117. The tensile strength is 7700 psi at 73° F. and 2750 psi at 180° F. The tensile modulus is 400,000 psi at 73° F. and 2750 psi at 180° F. The izod impact at 73° F. is 4.00 inch and heat distortion (264 psi) is 185° F. The U/L vertical 94 flame test (0.032 inch) is VO.

With regard to the most flexible portion of the tri-extrusion of the frame, such as the gasket 66 or the gasket 44, this is preferably made of a flexible black material such as a PVC identified as Geon #83741. Specific gravity is 1.36 with a durometer "A" 71+3 (81 maximum aged, ultimate tensile=1550 psi (1400 minimum aged). 100% modulus is 675 psi (750 maximum aged) ultimate elongation-310% (0.290% minimum aged) and brittleness temperature=−35° F. Aging for the above consists of 200 hours weatherometer (ASTM-E-42−57 type "E").

With regard to the semi-rigid capstock compound used for the capping 14B and 20B, this is also a product of B. F. Goodrich Company, Chemical Division, 6100 Oak Tree Boulevard, Cleveland, Ohio and identified as product GEON #86103. This has a specific gravity of 1.40 and a hardness shore "E"−1.40. The dimensional stability is 2% shrinkage with grain and 7% cross grain after ten minutes at 266° F. Water vapor transmission rate is 1 gm/100 square inches/24 hours for a 3 mill. film with a tear resistance of 0.5 pounds per mill. both with grain and cross grain (3 mill. film).

What is claimed is:

1. A skylight construction for an opening in a building or the like comprising:

a frame means extending about the opening and including means securable about the opening, translucent or transparent means covering the opening and extending at edges to overlie the frame means, means for retaining the covering means on the frame means, said frame means comprising multiple frame sections including a base frame and a support frame overlying the base frame, said frames having respective facing wall means, and at least one flexible gasket integrally formed with one of said facing wall means of one of the frame sections and disposed sandwiched between the wall means of the base frame and the wall means of the overlying support frame, wherein at least said one of said frame sections is constructed of a rigid thermoplastic material, and said flexible gasket is constructed of a flexible thermoplastic material, wherein said integral flexible gasket is coextruded with the facing wall means with which it is integrally formed, wherein said rigid thermoplastic material of said frame means is joined at the frame means mitres while the flexible gasket is also joined at the mitres to provide a continuous seal about the frame means.

2. A skylight construction as set forth in claim 1 wherein said rigid thermoplastic material forming the curb frame and said coextruded flexible thermoplastic material are commonly sealed to join the frame means mitres and also simultaneously secure the gasket at the frame means mitres to provide a continuous seal about the entire frame means.

3. A skylight construction as set forth in claim 2 wherein in the compressed position of the gasket it is flattened to spread the gasket over both said facing walls to provide a substantially equal contact areas of the gasket at respective facing walls.

4. A skylight construction as set forth in claim 1 wherein said flexible gasket has an expanded position when the support frame is moved away from the base frame and has a compressed position when the support frame is moved into a liquid tight sealed position relative to the base frame.

5. A skylight construction as set forth in claim 4 wherein the facing wall means opposite to the facing wall means that supports said flexible gasket has a wall segment of a width at least sufficient to receive the gasket thereover in the compressed position thereof.

6. A skylight construction as set forth in claim 1 wherein the facing wall means opposite to the facing wall means that supports said flexible gasket has a wall segment of a width at least sufficient to receive the gasket thereover in the compressed position thereof.

* * * * *